US005104120A

United States Patent [19]

Watterson et al.

[11] Patent Number: 5,104,120

[45] Date of Patent: Apr. 14, 1992

[54] EXERCISE MACHINE CONTROL SYSTEM

[75] Inventors: Scott R. Watterson, River Heights; William T. Dalebout; Curt G. Bingham, both of Logan, all of Utah

[73] Assignee: Proform Fitness Products, Inc., Logan, Utah

[21] Appl. No.: 306,861

[22] Filed: Feb. 3, 1989

[51] Int. Cl.[5] ..... A63B 21/005

[52] U.S. Cl. ..... 482/5; 482/7; 482/8; 482/54; 482/63

[58] Field of Search ..... 272/69, 70, 73, 129, 272/DIG. 5, DIG. 6; 128/25 R; 73/379; 434/247, 392

[56] References Cited

U.S. PATENT DOCUMENTS

| | | | |
|---|---|---|---|
| 4,358,105 | 11/1982 | Sweeney, Jr. | 272/73 |
| 4,378,111 | 3/1983 | Tsuchida et al. | 272/73 |
| 4,643,418 | 2/1987 | Bart . | |
| 4,708,337 | 11/1987 | Shyu | 272/69 |
| 4,749,181 | 6/1988 | Pittaway et al. | 272/69 |

FOREIGN PATENT DOCUMENTS 0199442 10/1986 European Pat. Off. ..... 272/134

OTHER PUBLICATIONS

Advertising sheet for TREK 200 Treadmill by Weslo, Inc., 1988.

Advertising sheet for T50 Treadmill by Proform, 1987.

Owner's Manual for the Proform T50 Treadmill, 1988.

*Primary Examiner*—Richard J. Apley

*Assistant Examiner*—Joe H. Cheng

*Attorney, Agent, or Firm*—Trask, Britt & Rossa

[57] ABSTRACT

A control system includes an adjustment knob to regulate the resistance of the exercise machine such as a treadmill, rowing machine, or stationary exercise cycle. Various indicia are positioned proximate the knob so the user may specifically select an exercise program and real time feedback of exercise performance through the use an ear clip supplying pulse information or other biological data which is converted and displayed for observation by the user.

8 Claims, 4 Drawing Sheets

EXERCISE MACHINE CONTROL SYSTEM

BACKGROUND OF THE INVENTION

1. Field

This invention relates to exercise machines which have means to resist movements of the user in the performance of exercises.

2. State of the Art

Typical exercise machines now widely in use have a resistance so that a user will suffer an exercise benefit upon the performance of a particular exercise. For example, a motorized treadmill may be used to perform walking or jogging type exercises with the resistance or degree of difficulty varying based on the angle of inclination of the treadmill surface with horizontal. In some models, the user may also adjust the speed of the tread to regulate the exercise.

Stationary exercise cycles similarly have a means to regulate the resistance. That is, many stationary exercise cycles have a rotating flywheel with resistance structure such as a brake to simulate the resistance experienced if one were to pedal a bicycle under actual conditions. By adjusting the resistance, the user can change the degree of difficulty being experienced in causing the flywheel to rotate by pedalling.

Similarly, rowing machines of the type that use a cable connected to a flywheel structure may be operated in a fashion similar to a stationary exercise cycle to vary the degree of resistance or the difficulty of particular exercises. For some users, a coordinated exercise program is desirable in which the hardness or the degree of difficulty of the exercise is varied throughout a selected exercise period such as one half of an hour.

Although adjustments have been available to regulate the hardness or degree of difficulty of a particular exercise, a control system with feedback has not been presented to provide the user with the ability to quantitatively and easily regulate the hardness throughout the course of a particular exercise or from one exercise period to another later exercise period.

SUMMARY OF THE INVENTION

A control system is presented for use with an exercise machine which has resistance means to resist movement of the user in the performance of exercises. It has control means interconnectable to the resistance means for operation by the user in an extemporaneous manner to control the resistance means to vary the resistance between an easy configuration for the performance of easy exercises and a hard configuration for the performance of hard exercises by the user of the exercise machine. The control system also includes indication means positioned proximate the control means to indicate the relative selection of the control means between the easy configuration and the hard configuration and feedback means interconnectable to the user to detect and supply selected biological data while the user is operating the exercise machine. Conversion means are connected to receive the biological data and to convert the biological data into selected display data. Display means are further interconnected to the conversion means and positioned for observation by the user performing exercises on the exercise machine to display the biological data, in real time.

The feedback means is desirably a pulse detector connected to the user to detect the user's pulse and to supply a signal reflective thereof to the conversion means. As known, the conversion means assumes that an average number of calories are burned at a given pulse rate, given that the pulse rate reflects the degree of exertion during the exercise. The display means also is capable of displaying pulse data and calorie burn data.

In a more preferred arrangement, the control system includes a chassis positioned on the exercise machine with the control means associated therewith for operation by the user. The conversion means and the display means are also adapted to the chassis.

The exercise machine may be a motorized treadmill in which the control means includes the speed adjustment to regulate the speed of the treadmill and an adjustment to operate the incline of the treadmill. The indication means may include an inclinometer adapted to the chassis with a scale positioned proximate thereto to indicate the relative inclination of the treadmill.

The exercise machine may also be a stationary exercise cycle. Control means includes a friction adjust mechanism to frictionally resist movement of the pedals of the stationary exercise cycle. The exercise machine may also be a rowing machine of the type which has a flywheel and cable arrangement.

A method of exercising is presented which includes use of the control system on an exercise machine in order to provide the user with means to control exercise by regulating the resistance and in turn the pulse rate and in turn the calorie burn of the user.

BRIEF DESCRIPTION OF THE DRAWINGS

In the drawings, which illustrate what is presently regarded as the best mode for carrying the invention.

DESCRIPTION OF THE ILLUSTRATED EMBODIMENT

Figure 1:
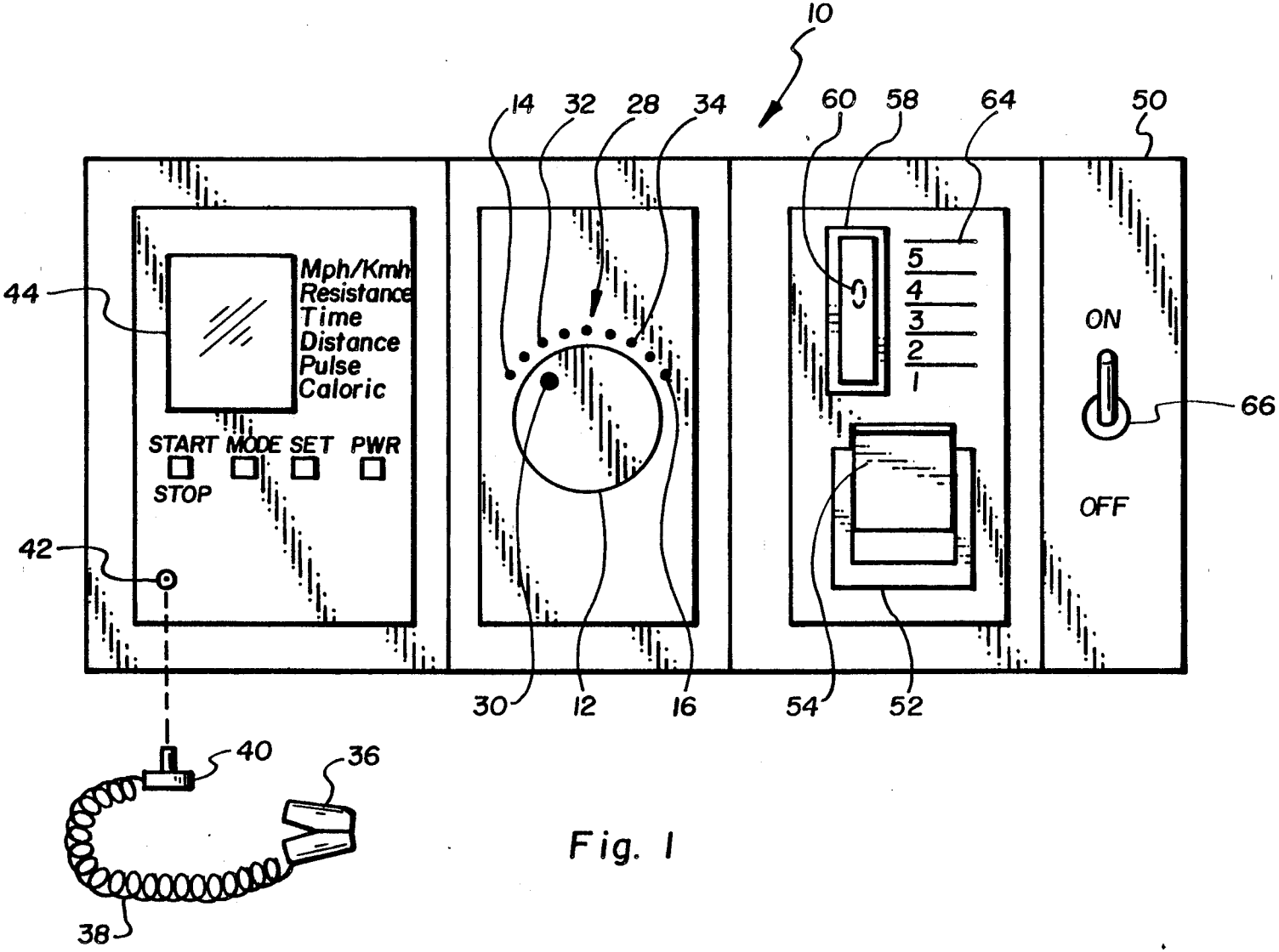
FIG. 1 is a frontal depiction of a control system of the instant invention.

FIG. 1 illustrates the observable components of a control system generally referred to by the number 10. The control system 10 includes control means which are here shown to include a knob 12 which is operable between an easy configuration 14 and a hard configuration 16. That is, knob 12 can be rotated between the easy configuration 14 and the hard configuration 16 as desired by the user to in turn regulate the resistance means of an exercise machine in which the resistance means resists movement of the user in the performance of selected exercises such as a treadmill of the type illustrated in FIG. 2.

Figure 2:
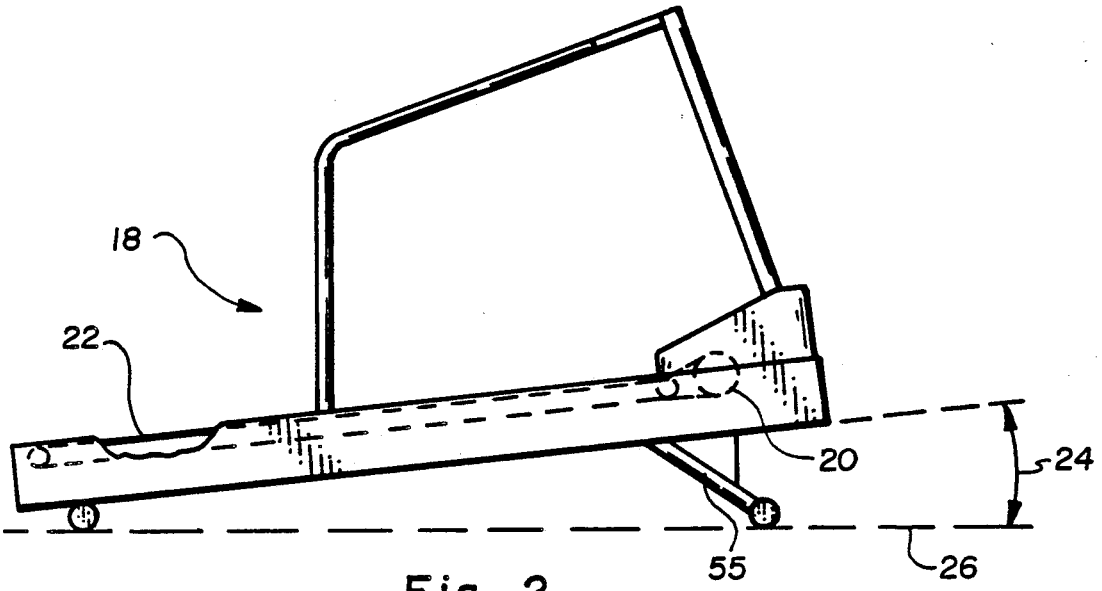
FIG. 2 is a side view depiction of a motorized treadmill of the type suitable for use with the instant invention.

Those skilled in the art will recognize that a treadmill 18 of the type shown in FIG. 2 is operated by a motor which is positioned interior of the chassis and is shown here in phantom 20 to in turn propel a tread or endless belt 22 upon which the user stands in order to walk or jog or run. Since the motor 20 typically can be operated at different speeds by operation of a desired control, it can be seen that the pace of the user can be voluntarily changed to increase the degree of difficulty of a particular exercise from a slow walk to a run (i.e., from easy to hard).

The treadmill 18 of FIG. 2 can be raised or lowered to adjust its inclination 24 with respect to the support surface 26 upon which the treadmill 18 resides. Increasing the inclination 24 can increase the degree of difficulty or hardness of the exercise (e.g., walking or jogging) between level and an uphill configuration (i.e., from easy to hard).

For the control system 10 shown in FIG. 1, the knob 12 is connected to vary the speed of a treadmill such as the treadmill 18 of FIG. 2 and more particularly the speed of the tread 22. Thus when the knob 12 is in position or configuration 14, the treadmill is in an easy configuration in which the resistance is set for the performance of easy exercises. That is, the treadmill is moving at a relatively slow speed so that the exercise being performed may be viewed as a walk. The knob 12 can then be positioned clockwise to the hard position 16. In the hard configuration 16 the resistance is set for the performance of hard exercises. That is, the speed of the tread 22 (FIG. 2) is increased so that the user by definition will need to jog or run at a substantially quicker pace, which is in turn deemed to be a hard exercise. As known, the user thereby increases his or her pulse rate as the user quickens his or her pace.

The control means also has indicia positioned proximate thereto. More particularly, the knob 12 has a scale 28 to indicate the relative selection between the easy configuration 14 and the hard configuration 16. An index or scribe 30 is imprinted on the knob 12 and may be rotated to register with any one of a plurality of dots or other index marks of the scale 28. Therefore a user may start an exercise with the index 30 in alignment or in registration with a dot such as dot 32. After a period of time the speed of the treadmill may be increased by acing the index 30 in registration with dot 34. Thus the user extemporaneously selects a harder exercise. The speed of the treadmill can thus be adjusted by the user according to his or her own experience, personal capability and desires.

The control means of FIG. 1 also includes feedback means which were shown to be a pulse clip 36 for interconnection to a finger, earlobe or similar appendage or portion of the body. The pulse clip 36 is known to those skilled in the art and senses the pulse of the user and transmits signals reflective thereof via conductors 38 to a connector 40 for further connection via receptacle 42 to a conversion system. That is, circuitry is provided to convert the biological data being received from the clip 36 through the connector 40 and receptacle 42. The conversion means converts the pulse data being transmitted into selected display data which may be shown on the face 44 of a display means which is here shown positioned for observation by the user performing exercises on the exercise machine. The circuitry (not shown) is available and may be easily assembled by those skilled in the art.

The biological data being received via the clip 36 and the connector 40 and receptacle 42 may be displayed on the display 44 as selected or as desired by the user. With the display of a particular biological function such as pulse, the user may operate the knob 12 to a pre-selected selected scale point such as the third dot 32 to vary the hardness of the exercise to achieve a particular pulse or pulse rate which would then be displayed on the screen 44. Thus the user can extemporaneously devise and operate an exercise program to regulate his or her own pulse rate in real time throughout the period of exercise.

The control system 10 preferably includes a chassis 50 which is positioned on the selected exercise machine with the control means associated therewith for operation by the user. The conversion means and the display means are also adapted to the chassis 50.

In one embodiment the exercise machine is a motorized treadmill such as the treadmill 18 previously described and shown in FIG. 2. The control means includes the knob 12 which functions as a speed adjustment to regulate the speed of the tread 22. The control means also includes an incline adjustment 52 which may be operated by the user to adjust the angle of incline 24 (FIG. 2) of the treadmill 18. As here shown, the incline adjustment 52 includes a paddle switch 54 which is interconnected connected to operate a cylinder to in turn operate the front leg structure 55 of the treadmill 18 of FIG. 2 similar to that illustrated and described in copending and commonly assigned U.S. patent application Ser. No. 009,270 filed Jan. 30, 1987, and now abandoned, the disclosure of which is hereby incorporated by reference thereto.

Figure 3:
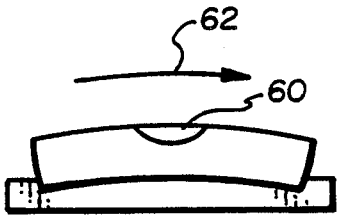
FIG. 3 is an enlarged side depiction of a portion of an inclinometer for use with the treadmill of FIG. 2.

The precise angle of inclination 24 is desirable information not heretofore available. The control system of FIG. 1 includes an inclinometer 58 which is mounted or adapted to chassis 50. Upon operation of the incline adjustment 52, the inclinometer 58 will indicate to the user the relative incline selected. A gas bubble 60 moves lengthwise 62 (FIG. 3) to indicate the relative inclination with respect to indicia 64 (FIG. 1) which is a numbered scale. Particular angle of inclination 24 (FIG. 2) for the number or index 64 (FIG. 1) is used to reposition the treadmill 18 to substantially the same level of inclination 24 as used in prior exercises or increased as desired by the user during the course of a particular exercise routine.

The control system of FIG. 1 may also include a simple on-off switch 66 to energize and de-energize the motor 20.

Figure 4:
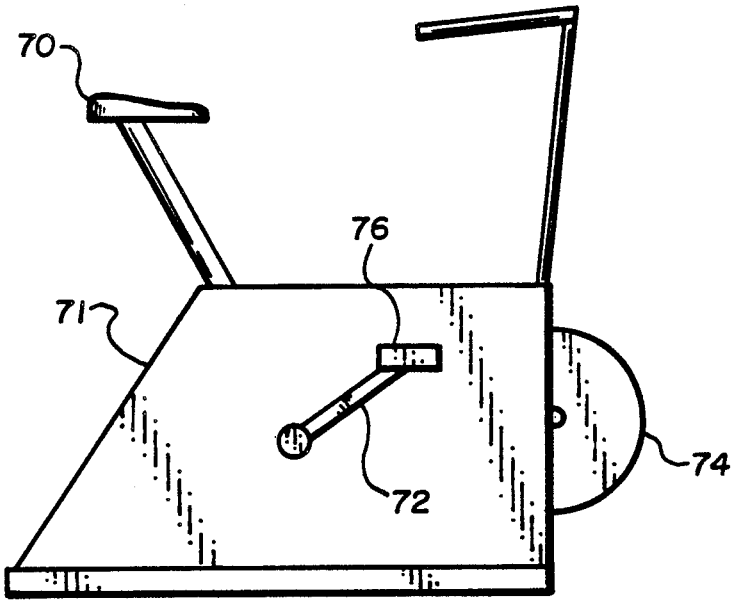
FIG. 4 is a side depiction of an exercise cycle of the type for which the control system of the instant invention may be used.

The exercise machine may also be an exercise cycle such as the one shown in FIG. 4. The cycle of FIG. 4 uses a control system as better illustrated in FIG. 5. The exercise cycle of FIG. 4 has a seat arrangement 70 adapted to a frame 71 which has a pedal or crank structure 72 interconnected by chains, brackets or other gear drive means to a flywheel 74. Exercise benefit is obtained by placing the user's feet upon pedals 76 and rotating the pedal mechanism 72 to in turn cause the flywheel 74 to operate. A brake, strap, band or other similar arrangement may be adapted to frictionally resist rotation of the flywheel 74. Such a resistance structure may be regulated by operation of a knob or lever on a variety of different known exercise cycles.

Figure 5:
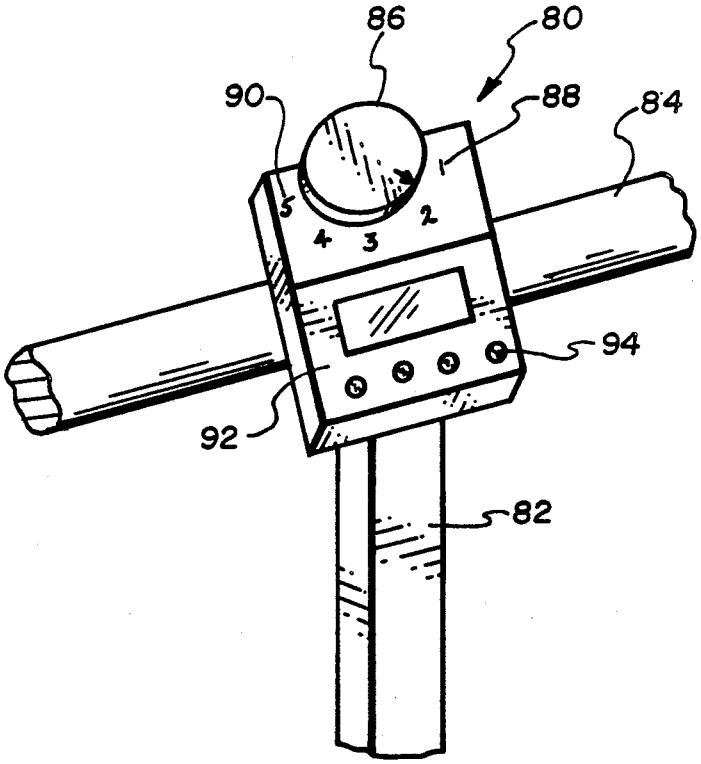
FIG. 5 is a partial three-dimensional cut-away depiction of a control system adapted to a stationary exercise cycle.

In the instant invention, control means 80 of FIG. 5 is shown adapted at the top of the upright post 82 of a cycle near the connection to handle bar structure 84. The control means of the claimed invention includes a knob 86 which is connected to the frictional resistance means in order to vary the resistance to the rotation of the flywheel 74 (FIG. 4) between an easy configuration 88 and a hard configuration 90. In the easy configuration, the resistance to the rotation of the flywheel 74 is selected to be minimal so that the user may easily and comfortably pedal the pedal mechanism 72. The knob 86 may be rotated to the hard position or configuration 90 in which considerable amount of resistance is imposed to resist the movement of the flywheel 74 and in turn cause the user positioned on the exercise cycle to pedal more strenuously to cause rotation of the flywheel 74.

The control system 80 shown in FIG. 5 includes display means 92 to display a variety of different functions. The display means 92 also includes feedback means and conversion means to convert feedback data such as pulse rate data. The feedback means includes a pulse clip, such as the clip 36, which plugs into receptacle 94. Operation of the control means 80 is substantially the same as discussed in reference to the control means of FIG. 1.

In another embodiment, a rowing machine 100 is provided. It is of the type which has a cable 102 that is pulled in and out against a resistance arrangement by the user pulling on a handle or other means affixed to the distal end of the cable 102. The rowing machine 100 includes a base frame structure 104 and foot supports 106 and 108. A control system shown on the rowing machine 100 of FIG. 6 regulates the resistance against movement of the cable 102 in a matter substantially identical to that described with respect to FIG. 5.

Figure 7:
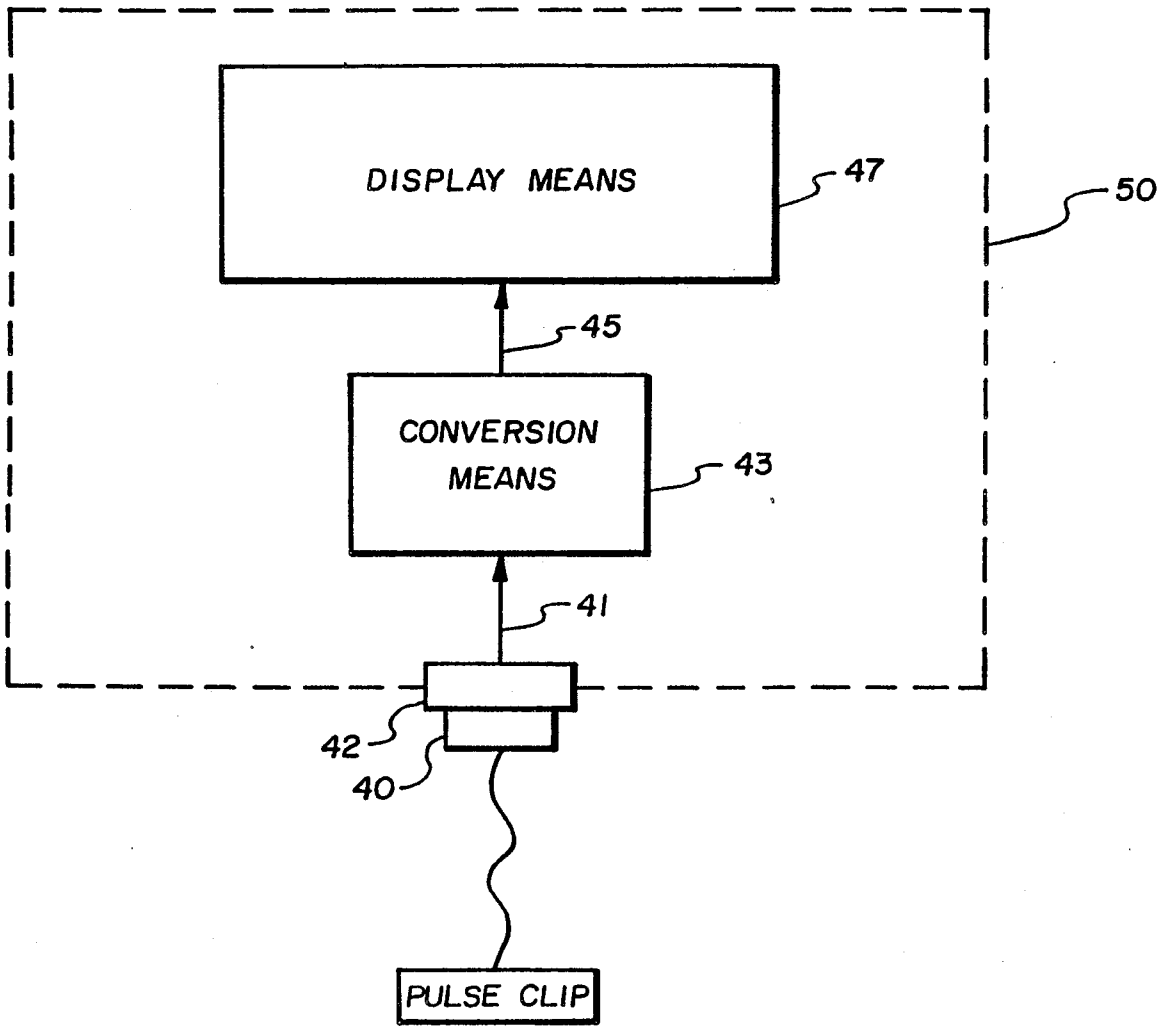
FIG. 7 is a block diagram of portions of the control system of the instant invention.

FIG. 7 shows a simplified block diagram of portions of the described control system for the treadmill (FIG. 2). Pulse data is detected by a pulse clip 36 which is appended to the user as hereinbefore stated. The pulse data is transmitted via conductor 38, through connector 40 and receptacle 42, to the conversion means 43 via conductor 41. As hereinbefore stated, the conversion means 43 converts the pulse data using constants to supply selected display data via conductor 45 to the display means 47.

Figure 6:
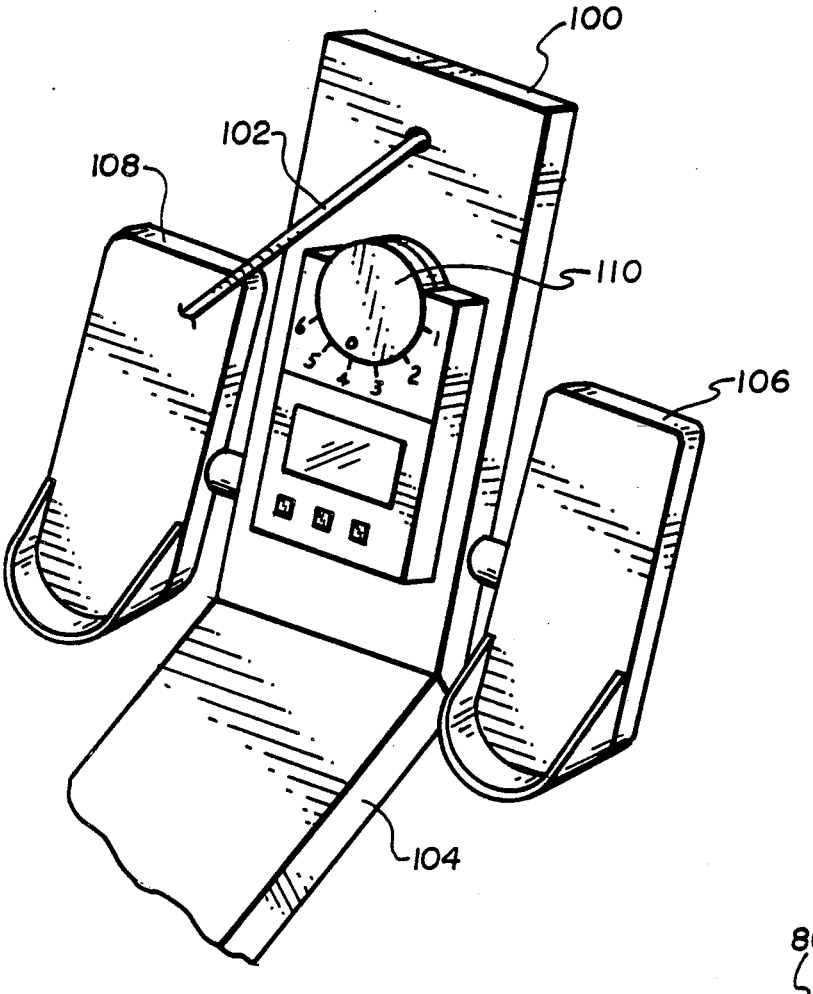
FIG. 6 is a portion of a rowing machine with cable having a control system of the instant invention adapted thereto.

In operation the user is positioned on a selected exercise machine. The user undertakes to operate the exercise machine by either pedalling, rowing, jogging/running, or the like. The degree of difficulty or resistance being imposed to the performance of the exercise is controlled and adjusted by control means which are here shown to be adjustment knobs 12 (FIG. 1), 86 (FIG. 5) and 110 (FIG. 6). Upon operation of the knob, the user can in turn control his or her own pulse rate and in turn his or her own rate of and total calorie burn assuming the average amount of calories are burned for a given degree or quantity of exercise. Using standard conversions, the user may be in a position to control his or her pulse rate and in turn the calorie burn rate to secure the maximum benefit from performance of particular exercises.

It is to be understood that the embodiments of the invention of the above described are merely illustrative of the application of the principals of the instant invention. Reference herein to details of the illustrated embodiment is not intended to limit to scope of the claims which themselves recite those features regarded as essential to the invention.

We claim:

1. A control system for controlling an exercise machine having resistance means to resist movement of the user in the performance of exercises, said control system comprising:

control means interconnectable to the resistance means of an exercise machine for extemporaneous manual operation by the user during performance of the exercises on said exercise machine without interrupting said performance of the exercises to set said resistance means between an easy configuration in which said resistance means is set for the performance of easy exercises by the user on said exercise machine and a hard configuration in which said resistance means is set for the performance of hard exercises by said user on said exercise machine;

indication means positioned proximate said control means to indicate the relative selection of said control means between said easy configuration and said hard configuration;

pulse detection means interconnectable to said user to detect and supply a pulse signal reflective of the user's pulse while said user is operating said exercise machine;

conversion means connected to receive said pulse signal and to convert said pulse signal into selected biological display data; and display means interconnected to said conversion means to display said selected biological display data including said pulse signal in real time and positioned for observation by said user while performing exercises on said exercise machine.

2. The control system of claim 1 wherein said selected biological display data includes a rate of calorie burn, wherein said conversion means provides said pulse signal and said rate of calorie burn to said display means, and wherein the display means includes means to display said rate of calorie burn.

3. The control system of claim 2 further including a chassis positionable on said exercise machine, said control means being adapted to said chassis for operation by the user, and said conversion means and said display means also adapted to said chassis.

4. The control system of claim 3 wherein said control means is adapted to control a motorized treadmill having tread and arranged with an incline, wherein said control means includes a speed adjustment means connectable to regulate the speed of the tread and incline adjustment means connectable to operate means to regulate the incline of said treadmill.

5. The control system of claim 4 wherein said indication means includes an inclinometer adapted to said chassis and a scale positioned proximate said inclinometer to indicate the relative inclination of said treadmill.

6. The control system of claim 5 wherein said indication means further includes a scale positioned proximate said speed adjustment to indicate settings between a slow speed and a fast speed.

7. The control system of claim 3 wherein said control means is adapted to control a stationary exercise cycle having a frictional resistance mechanism to frictionally resist movement of pedals of said stationary exercise cycle, wherein said control means further includes frictional adjustment means connectable to said frictional resistance mechanism to vary the amount of friction exerted thereby.

8. A method for controlling an exercise machine having adjustable resistance means to resist movement of the user performing exercises, said method comprising:

providing an exercise machine having adjustable resistance means operable between selected positions to resist movement of the user performing exercises thereon;

interconnecting a control means to said adjustable resistance means of the exercise machine;

extemporaneously manually operating said control means during performance of the exercises without interrupting said performance of exercises to adjust said resistance means between an easy configuration in which said resistance means is set for the performance of easy exercises by the user on the exercise machine and a hard configuration in which said resistance is set for the performance of hard exercises by the user on the exercise machine;

providing indication means and positioning it proximate said control means to indicate the relative selection of a position of said control means between said easy configuration and said hard configuration;

providing a pulse detector and connecting it to the body of a user to supply a pulse signal reflective of the user's pulse during exercise;

providing conversion means and connecting it to said pulse detector to receive said pulse signal and for generating a calorie burn rate signal and supplying a signal reflective of said calorie burn rate and for supplying said pulse signal;

providing a display means to receive and to display said pulse signal and said calorie burn rate signal and connecting said conversion means thereto to receive said signals reflective of said calorie burn rate and said pulse signal;

causing said conversion means and said display means to operate;

observing said display of said pulse signal and said calorie burn rate, and in response thereto, manually operating said control means as desired and in an extemporaneous manner to adjust said resistance means to another selected position from said hard configuration to said easy configuration to regulate the pulse rate of the user.

* * * * *